US005950465A

United States Patent [19]

Schultz et al.

[11] Patent Number: 5,950,465

[45] Date of Patent: Sep. 14, 1999

[54] DEADLOCK BOLT SECURITY LOCK

[76] Inventors: Theodore J. Schultz, 5010 Live Oak Cir., Bradenton, Fla. 34207-2218; Charles Boche, 2723 Rocker Feller Cir. #7, Redondo Beach, Calif. 90278

[21] Appl. No.: 09/084,411

[22] Filed: May 26, 1998

[51] Int. Cl.[6] ..... E05B 17/00

[52] U.S. Cl. ..... 70/416; 70/429

[58] Field of Search ..... 70/416, 429, 430

[56] References Cited

U.S. PATENT DOCUMENTS

| | | | |
|---|---|---|---|
| 342,554 | 5/1886 | Whidden | 70/429 |
| 583,669 | 6/1897 | Bruning | 70/429 |
| 584,532 | 6/1897 | Welker | 70/429 |
| 607,381 | 7/1898 | King et al. | 70/429 |
| 1,050,968 | 1/1913 | McKay | 70/429 |
| 1,343,615 | 6/1920 | Caralun | 70/429 |
| 1,887,951 | 11/1932 | Crum | 70/430 |
| 2,601,644 | 6/1952 | Swem | 70/429 |
| 3,423,974 | 1/1969 | Bernsley | 70/416 |
| 3,748,882 | 7/1973 | Dusault et al. | 70/416 |
| 5,003,803 | 4/1991 | Richards | 70/416 |
| 5,067,334 | 11/1991 | Sorkilmo | 70/416 |
| 5,313,812 | 5/1994 | Eklund et al. | 70/416 |
| 5,369,971 | 12/1994 | Sheppard | 70/416 |
| 5,515,704 | 5/1996 | Van Nguyen | 70/416 |
| 5,651,279 | 7/1997 | Berton et al. | 70/416 X |

*Primary Examiner*—Suzanne Dino Barrett
*Attorney, Agent, or Firm*—Frank A. Lukasik

[57] ABSTRACT

A deadlock bolt or key bolt securing assembly adapted to be fastened to a door or panel by an adhesive is provided. The assembly includes a base supporting member and a locking means having a locking arm for positioning the locking means over an operating key or handle to prevent the key or handle from being turned from the outside. When a lock is in the open position, the locking arm may be laid back against the supporting door or panel.

1 Claim, 3 Drawing Sheets

DEADLOCK BOLT SECURITY LOCK

BACKGROUND OF THE INVENTION

1. Field of the invention

The present invention relates to a means and method for ensuring the integrity of the locking devices on most homes, apartments, storage sheds having more than one entrance, and the like where presently employed locking means are susceptible of being overcome from the exterior by the use of unauthorized duplicate keys, master keys, stolen keys or other felonious devices, and, in the instance of deadlock bolt devices, the use of unauthorized equipment to withdraw the securing bolts. More particularly, this invention relates to a deadlock bolt securing assembly that is fastened to a door or panel by an adhesive and includes a fitting which is positioned over the operating key or handle to prevent the key or handle from being turned from the outside.

2. Description of the Prior Art

Disclosed in the prior art are various devices for preventing unauthorized entry into locked spaces whereby security is thought to be achieved through key-operated bolts, deadlock bolts or both. For example, U.S. Pat. No. 5,651,279 to Berton et al discloses a complex deadlock bolt and supporting assembly having a base that is permanently attached to the entry door with adhesive. The locking mechanism is adhesively secured to a door adjacent to an inside cylinder locking device and includes a spring-loaded hinged restraining plate, a catch for locking it in the open position, and a restricting edge so that when the catch is released the restricting edge is sprung to a position abutting the operating knob of the bolt to prevent to prevent rotation thereof by exterior means. The only similarity of this device to the present invention is the use of an adhesive to attach the mechanism to the entry door. The spring-loaded restraining plate must be locked when not in use, and it could not receive a key head or lock knob. It abuts against only one side of the dead bolt knob.

U.S. Pat. No. 5,313,812 to Eklund et al discloses a door lock security device comprising a base plate that fits beneath the face plate of the lock and is adapted during installation to be oriented to the shaped actuating handle of the lock. With the base plate installed beneath the face plate of the lock and the lock handle rotated to extend its bolt, the locking plate is rotated about a pivot post, swinging an arcuate passage over the lock handle thereby immobilizing it from rotation despite the use of a proper key externally. This security device differs fundamentally from the present invention. Removal of the face plate of the lock is required for installation of a base plate, the base plate is pivoted into position over the lock handle, and the assembly could not accommodate a key head among other distinguishing features.

The locking device of U.S. Pat. No. 5,369,971 to Sheppard requires the removal of an existing lock face plate and the insertion between the face plate and its supporting structure of a security mounting plate and locking mechanism that comprises a manually manipulated locking arm member which substantially envelops the dead bolt operating knob on the inside of an entry door to prevent angular rotation of the knob and withdrawal of the deadlock bolt by the use of a pass key or an unauthorized device. The mounting plate is provided with a central aperture for receiving the deadlock bolt actuating tongue and the locking mechanism includes a bracket which is connected to a locking arm means. The bracket is secured to the mounting plate and the mounting arm means is pivotally mounted on the bracket and adapted to extend to and over the deadlock bolt operating knob, thereby precluding unauthorized rotation of the operating knob by external means. The bracket includes a resilient arm and a housing connected thereto for positioning over the operating knob. The pivoting and resilience of the locking arm allow it to be rotated downwardly and positioned over the knob and, in removal, to be flexed outwardly and pivoted away to a position parallel with the bracket. As noted, the removal of the existing lock face plate is required, and a complex mechanism is required which includes a bracket and a spring arm. This device also could not, as shown and described, accommodate a key head.

U.S. Pat. No. 5,689,984 to Diculescu et al discloses a security lock system comprising a face plate locatable upon a dead bolt lock. The face plate has first and second apertures extending through it above and below the turn knob. A planar member with a circular hole is affixed to the face plate and extends within the dead bolt lock opposite from the turn knob. The C-shaped component includes a first horizontal bar, a second horizontal bar and a vertical bar. Each horizontal bar has an inboard end and an outboard end. The first and second horizontal bars are pivotally coupled in a generally perpendicular orientation to the upper and lower ends of the vertical bar, respectively. This device requires substantial modification of an existing bolt assembly, could not accommodate a key head, and fails to teach, suggest or infer other features of the present invention.

It can readily be appreciated that these references, either singly or in combination, do not teach, suggest or infer the method and means of the present invention for providing security while not requiring removal of a base plate to attach the deadlock bolt or key bolt assembly.

SUMMARY OF THE INVENTION

Accordingly, it is an object of the invention to provide a system for preventing unauthorized withdrawal of locking bolts in doors or panels which does not require the removal of an existing lock base plate or the use of complex mechanisms.

It is another object of the invention to provide such a system which does not require modification of existing lock components.

It is a still further object of the invention to provide in such a system means for immobilizing a key left inserted in the lock.

It is yet another object of the invention to provide such a system wherein the locking means base is secured by adhesive to a door or panel surface, the locking means is adjustably positioned when the base is adhered, and the locking means is adapted to receive either a lock handle or a key head to effect lock security.

The foregoing objects are realized by the present invention in a two component system which includes a base plate for securing fixed support means to a surface preferably by a double-sided self-sticking adhesive, the base plate having upstanding members attached there to preferably by welding, and a channel member mounted on an arm which extends from the upstanding members and adapted to fit over and confine a lock handle. In an alternate embodiment, the channel member is provided with a longitudinal slot for receiving the head of a key and the upstanding members are provided with means for displacing the channel members to receive the head of the key.

BRIEF DESCRIPTION OF THE DRAWINGS

The foregoing and further objects or the invention will become apparent from reading the following detailed description of preferred embodiments of the invention, in which.

DETAILED DESCRIPTION OF THE INVENTION

Figure 1:
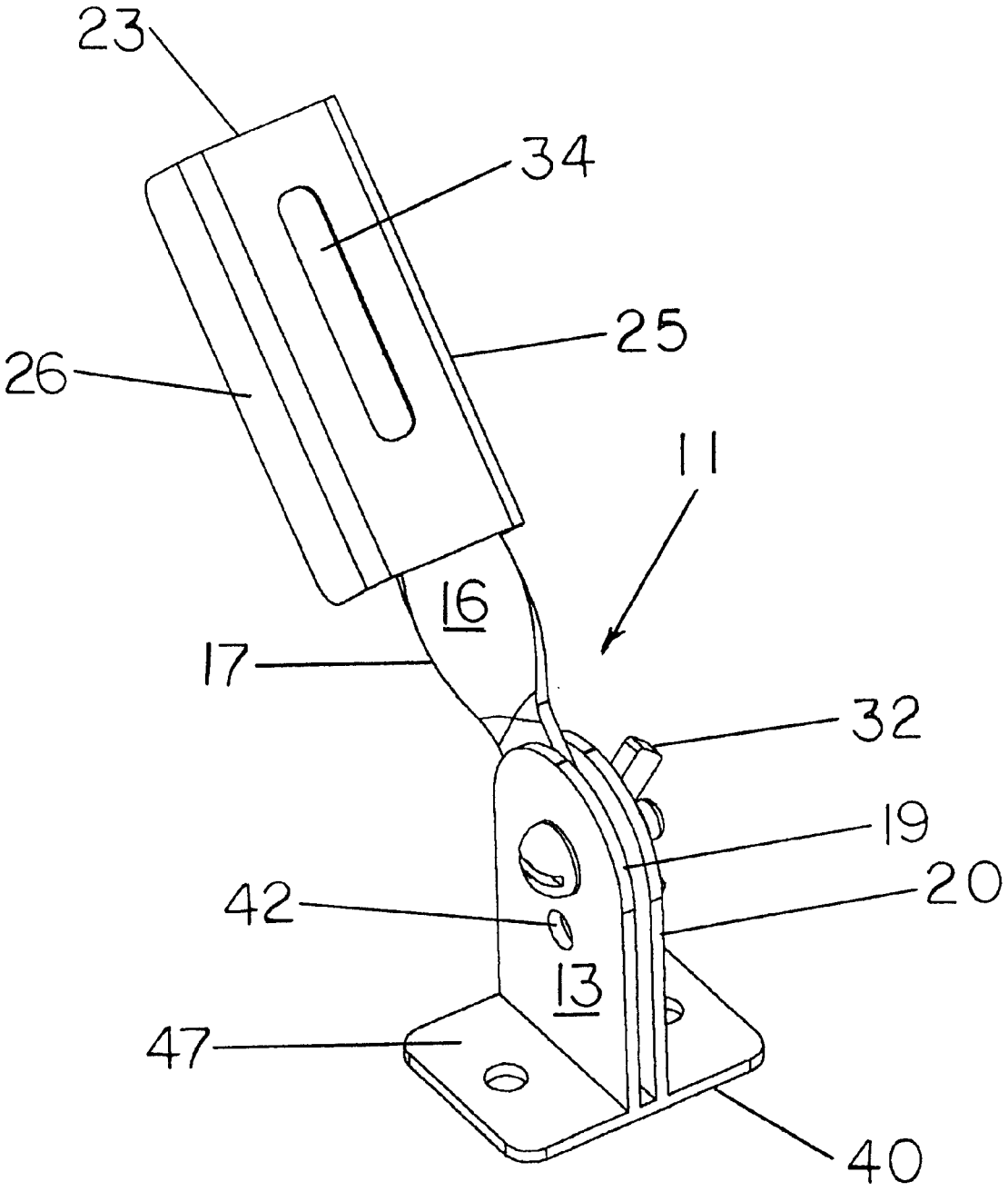
FIG. 1 is a perspective view of a preferred embodiment of the invention.
Figure 2:
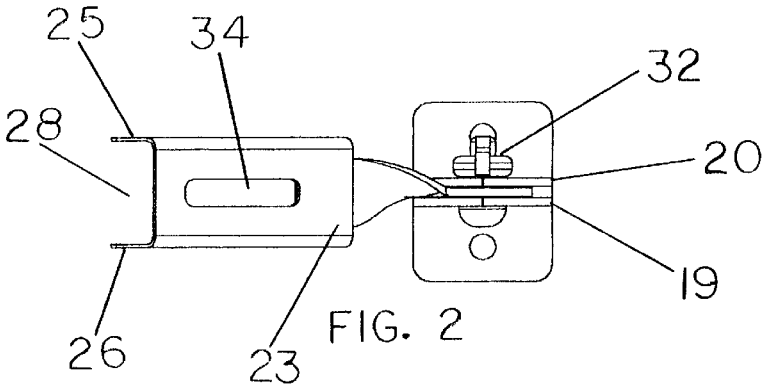
FIG. 2 is a plan view of the invention.

Turning now to the drawings, more particularly to FIG. 1, there is shown a preferred embodiment of the invention 11 with its two components, a base supporting member 13 and a locking means 16 which means includes a locking arm 17 pivotally mounted on the base member. The base member includes upstanding supports 19 and 20 spaced apart sufficiently to receive therebetween one end of locking means 16, the other extended end thereof 23 being attached thereto preferably by welding, not shown. Extended end 23 has its sides 25 and 26 bent downward to form a channel 28, as shown in FIG. 2, whose width is determined by the dimensions of a lock handle 30, shown in FIG. 5, to be retained therein. A bolt and wing-nut set 32 serves to secure locking arm 17 to base 13 and a slot 34 is adapted to receive a key head 35, shown in FIG. 5. The invention is adhered to a planar surface, such as 38 shown in FIG. 5, by a 3M Scotch self-sticking adhesive 40. It will be appreciated that channel 28 in the form shown is also adapted to receive lock handle 30, shown in FIG. 5, upon repositioning locking means 16 so that wing-nut set 32 is installed in an opening 42 in upstanding members 19 and 20, only one of which is shown.

Figure 3:
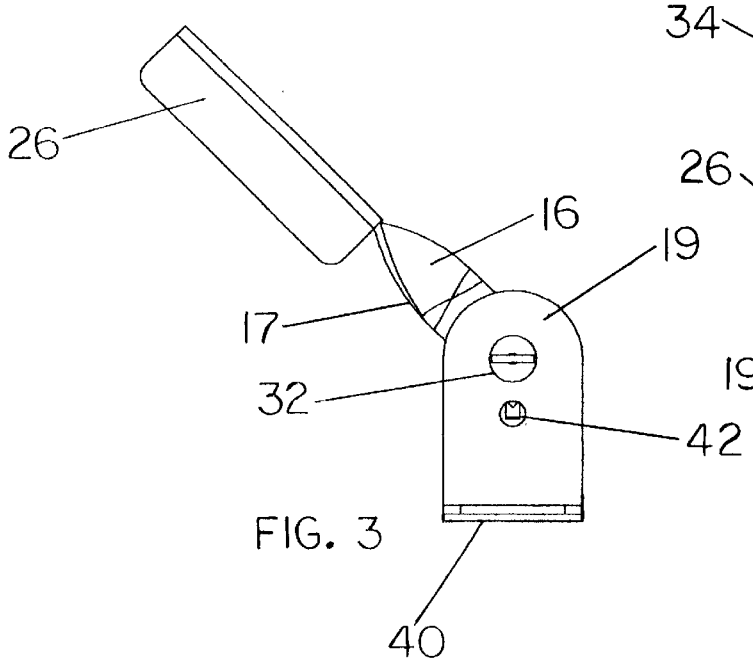
FIG. 3 is a side elevation of the invention.
Figure 4:
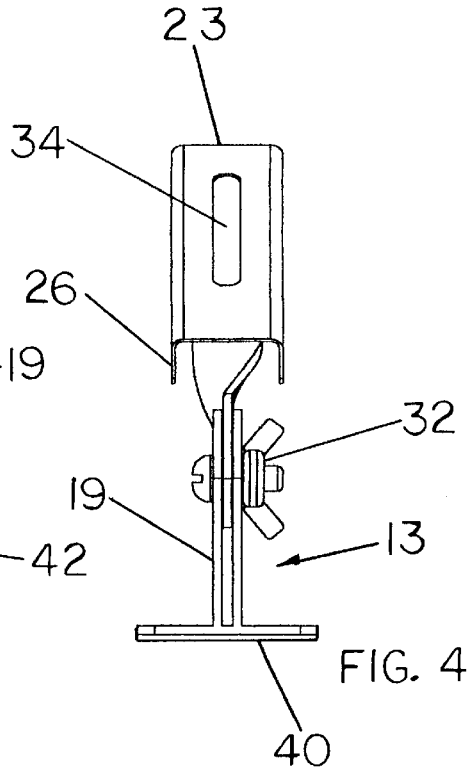
FIG. 4 is an end elevation of the invention.

FIGS. 2–4 are other views of invention 11 not in perspective which illustrate channel 28 and wing-nut set 32 more clearly.

Figure 5:
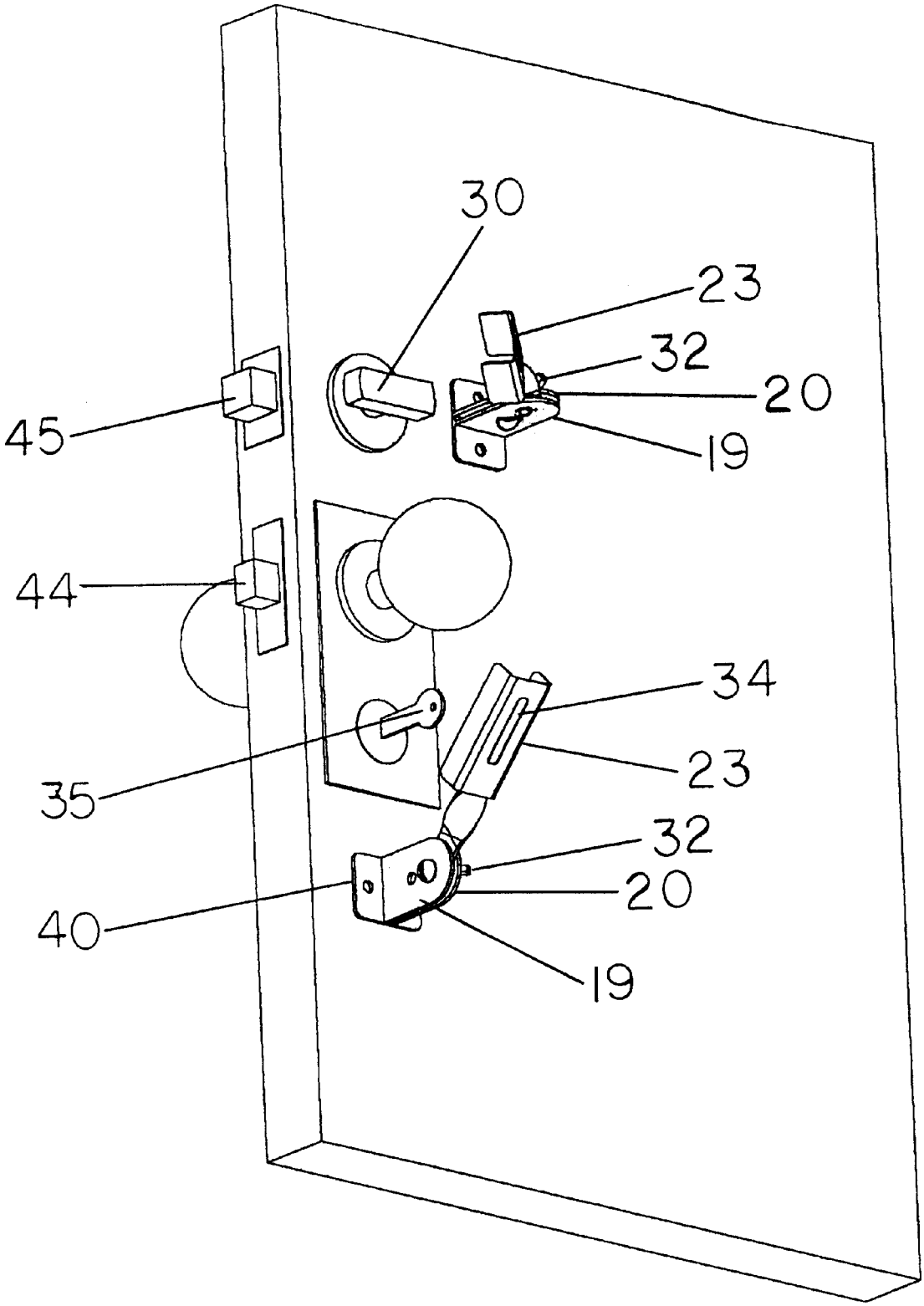
FIG. 5 is a perspective view of alternate embodiments of the invention mounted on a surface having two distinct locking means.

FIG. 5 shows the invention in use both in relation to key 35 operable with respect to a bolt assembly 44 and lock handle 30 operable with respect to a bolt assembly 45.

In operation, referring in particular to FIGS. 1 and 5, the invention is shown with locking means 16 in an elevated position so that it may be lowered over key head 35 and then secured in place by tightening wing-nut set 32. In this condition, rotation of key head 35 is prevented thereby precluding withdrawal of bolt 44 and thus assuring the integrity of a security closing means in a locked door or panel. Locking means 16 is also shown in an alternate elevated position in relation to lock handle 30 so that it may be lowered over the lock handle thereby also assuring the integrity of the locked door or panel.

In the embodiments shown, all components of the invention preferably are made of a metal such as iron or steel in order that they may be securely welded together. That is, upstanding supports 19 and 20 are welded to a base piece 47 and locking arm 17 is welded to extended end 23.

Although this invention has been disclosed and described with reference to a preferred embodiment, its principles are susceptible to other applications which will be apparent to persons skilled in the art. For example, the components of the invention may be made of synthetic material such as teflon or other hardened sheet plastic and bonded together by epoxy or other adhesive in lieu of being welded together. In addition, the invention may be affixed to an appropriate surface by conventional bolts or screws in lieu of self-sticking adhesive 40. Also, in lieu of separate openings for wing-nut set 32 a vertical slot may be provided in upstanding supports 19 and 20 for repositioning of locking means 16. Thus, many modifications, additions, and deletions may be made to the invention without departure from the scope of the invention as set forth in the following claims

What is claimed is:

1. A key head and lock handle restraining device consisting of:

a base supporting member having two, spaced apart, upstanding supports and a bottom surface, said supports having a first hole formed in said upstanding supports in an elevated position and a second hole formed in said upstanding supports in an alternate elevated position, said bottom surface being coated with a self-sticking adhesive, a locking arm having a pivotal end and an extended end, said extended end having a first side and a second side bent downwardly to form a channel having a width determined by the width of the lock handle and adapted to receive a lock handle, and said extended end having a longitudinal slot formed therein between and parallel to said first and second sides, said slot being adapted to receive a key head, a bolt and wing nut set, and inserting said locking arm pivotal end between said spaced apart upstanding supports and positioning said pivotal end for pivoting on said bolt and wing nut set positioned in one of a selected first or second hole formed in said upstanding supports.

* * * * *